US008925209B2

(12) United States Patent
Van Der Scheer et al.

(10) Patent No.: US 8,925,209 B2
(45) Date of Patent: Jan. 6, 2015

(54) UNIT FOR CLEANING AN INTERIOR SPACE OF A SHAVING HEAD OF A SHAVER

(75) Inventors: Robbert Freerk Johan Van Der Scheer, Drachten (NL); Ype Brada, Drachten (NL); Sint Baron, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 1217 days.

(21) Appl. No.: 12/518,304

(22) PCT Filed: Dec. 10, 2007

(86) PCT No.: PCT/IB2007/054977

§ 371 (c)(1), (2), (4) Date: Jun. 9, 2009

(87) PCT Pub. No.: WO2008/075243

PCT Pub. Date: Jun. 26, 2008

(65) Prior Publication Data

US 2010/0059092 A1 Mar. 11, 2010

(30) Foreign Application Priority Data

Dec. 15, 2006 (EP) ..... 06126263

(51) Int. Cl.

| | |
|---|---|
| ***B08B 3/00*** | (2006.01) |
| ***B26B 19/38*** | (2006.01) |
| ***A45D 27/46*** | (2006.01) |

(52) U.S. Cl.

CPC ..... *B26B 19/38* (2013.01); *B26B 19/3833* (2013.01); *A45D 27/46* (2013.01)

USPC ..... 30/538; 134/110

(58) Field of Classification Search

CPC ..... A45D 27/46

USPC ..... 30/538

See application file for complete search history.

(56) References Cited

U.S. PATENT DOCUMENTS

| | | | |
|---|---|---|---|
| 3,369,294 | A | 2/1968 | Shaw |
| 5,839,457 | A | 11/1998 | Rijken et al. |
| 2006/0107971 | A1 | 5/2006 | Chasen et al. |

FOREIGN PATENT DOCUMENTS

| | | | |
|---|---|---|---|
| DE | 10332385 | A1 | 2/2005 |
| JP | 54143018 | A | 11/1979 |
| JP | 06178876 | A | 6/1994 |
| WO | 2005000539 | A1 | 1/2005 |
| WO | 2005016061 | A1 | 2/2005 |
| WO | 2006067667 | A1 | 6/2006 |

*Primary Examiner* — Jason Ko

(57) ABSTRACT

A cleaning unit (1) is provided for cleaning an interior space (15) of a shaving head (10) of a shaver, which shaving head (10) comprises a movably arranged cutter member (20) for cutting off hairs and a contacting surface (14) for contacting a portion of skin to be shaved, which is provided with a plurality of holes for catching and letting through hairs to 5 be shaved off by means of the cutter member (20). In particular, the cleaning unit (1) comprises separating means (30) for constituting a physical barrier between two portions of an outer surface (13) of the shaving head (10) and for conveying cleaning fluid (41). During a cleaning process, an agitated flow of fluid (41) is realized in the interior space (15) of the shaving head (10) under the influence of a centrifugal pump action which is obtained when 10 the cutter member (20) of the shaving head (10) is in motion.

2 Claims, 12 Drawing Sheets

UNIT FOR CLEANING AN INTERIOR SPACE OF A SHAVING HEAD OF A SHAVER

FIELD OF THE INVENTION

The present invention relates to a unit for cleaning an interior space of a shaving head of a shaver, which shaving head comprises a cutter member which serves for cutting off hairs, and which is movably arranged inside the interior space, wherein a portion of an outer surface of the shaving head is a contacting surface which serves for contacting a portion of skin to be shaved, and which is provided with a plurality of holes for catching and letting through hairs to be shaved off by means of the cutter member.

The present invention also relates to a device for cleaning an interior space of shaving heads of a shaver having at least two shaving heads.

BACKGROUND OF THE INVENTION

WO 2005/016061 discloses a cleaning device for cleaning a shaving head of a shaver. The known cleaning device comprises a station housing, a holding device, a cleaning fluid container, a fluid impelling assembly for pumping a cleaning fluid, a supply conduit leading to a cleaning well having a drain above a wall, a fluid discharge port as well as a filter element.

The cleaning well has an inner curvature shaped to conform approximately to an outer contour of the shaving head. During a cleaning cycle, the level of cleaning fluid in the cleaning well must always be such as to encompass a major part of the shaving head to accomplish a good cleaning operation.

The cleaning device known from WO 2005/016061 has a major drawback, which resides in the fact that this device needs to have a fluid impelling assembly for pumping the cleaning fluid. In particular, the fluid impelling assembly comprises an electric motor, which is housed in an interior space of the cleaning fluid container and designed to slide out of this interior space, so that it is possible for the cleaning fluid container to be removed from the cleaning device and replaced by another one. It is understood that the fluid impelling assembly of the design as described contributes significantly to the cost price of the cleaning device.

WO 2005/000539 discloses a method of cleaning a hair chamber of a shaver, wherein it is not necessary to apply a separate assembly for pumping the cleaning fluid. According to the method, cleaning fluid is displaced through the hair chamber by at least one liquid displacement impeller driven by a motorized drive structure of the shaver. Consequently, there is no need for the application of a separate fluid-impelling assembly.

During a cleaning process, the impellers are driven, as a result of which cleaning fluid is agitated inside the hair chamber, causing the fluid to whirl and/or splash against internal surfaces inside the hair chamber, thereby entraining hair and skin particles from these surfaces in the hair chamber. In a practical embodiment, the shaver comprises only one motor, wherein both the drive structure for driving the impellers and the cutter members are coupled to this motor.

For feeding fluid into the hair chamber, the hair chamber communicates with the environment through at least two flushing passages, one of the passages serving for letting the fluid into the hair chamber, and another of the passages serving for letting the fluid out of the hair chamber. The cleaning fluid may be water, which is supplied to the hair chamber by simply holding a portion of the shaver containing the inlet of the flushing passage in a flow of water running from a tap or in water in for instance a bowl or glass. It is preferred to supply cleaning agents, for example in concentrated form, prior to the water supply or dissolved in water that is supplied through the inlet of the flushing passage.

SUMMARY OF THE INVENTION

It is an object of the present invention to provide a unit for cleaning an interior space of a shaving head of a shaver, which unit does not require a separate assembly for pumping cleaning fluid and which does not require immersion of the complete shaving head in the cleaning fluid, in order to reduce the time it takes for the shaving head and adjacent portions of the shaver to dry, and to prevent exposure of these adjacent portions to the possible aggressive cleaning fluid, and which unit is still capable of achieving excellent cleaning results. In particular, it is an object of the present invention to provide a cleaning unit which is especially suitable to be applied for cleaning an interior space of a shaving head having a rotatably arranged cutter member and having a relatively small hair chamber, which hair chamber only serves for receiving hair that is cut off by means of the cutter member arranged in that particular shaving head, and, in case the shaver comprises more than one shaving head, is not shared with another shaving head.

According to the present invention, a cleaning unit comprising separating means which are adapted to constitute a physical barrier between two portions of the outer surface of the shaving head in an operational state of the unit, in which a shaver is put in place in the unit, and which are suitable for conveying fluid is provided.

The present invention is based on the insight that it is possible to have a shaving head in which a centrifugal pump action is obtained when the cutter member of the shaving head is rotated, and that the centrifugal pump action may be applied to pump cleaning fluid to and from the interior space of the shaving head. The present invention proposes to use separating means for constituting a physical barrier between two portions of the outer surface of the shaving head, so that it is possible to separate a portion of the outer surface where the fluid flows into the interior space of the shaving head from a portion of the outer surface where the fluid flows out of the interior space of the shaving head. The application of the separating means has some important advantages, which will become apparent from the following description of preferred embodiments of the cleaning unit according to the present invention.

It follows from the foregoing that the cleaning unit according to the present invention is particularly suitable to be applied for cleaning a shaving head having a rotatably arranged cutter member and a relatively small hair chamber. In a practical embodiment, such a shaving head comprises a cap covering the cutter member, wherein the contacting surface of the shaving head is constituted by at least a portion of an outer surface of the cap. It appears that in such a case, when the cap of the shaving head is put into contact with a quantity of fluid, and the shaving head is kept closed, fluid is forced to flow into the interior space of the shaving head through a central portion of the contacting surface, and that fluid is forced to flow out of the interior space of the shaving head through an annular portion of the contacting surface, which is surrounding the central portion. Therefore, in order to achieve a proper separation of the incoming flow and the outgoing flow, it is advantageous if the separating means are adapted to constitute a physical barrier between the said central portion of the contacting surface and the said annular portion. The application of the separating means contributes to maintaining pressure differences under the influence of which the flow of fluid takes place.

Preferably, in a practical embodiment of the cleaning unit according to the present invention, the separating means comprise a tube-shaped member. When it is desired to have a cleaning unit in which it is possible to perform a cleaning process during which both an incoming flow and an outgoing flow of fluid take place through the contacting surface of the shaving head, at portions of this surface which are kept separated from each other, it is advantageous when dimensions of a cross-section of the tube-shaped member, at an end of the tube-shaped member which serves for contacting the outer surface of the shaving head, are smaller than dimensions of the contacting surface. By applying the tube-shaped member, putting this member and the shaving head in place with respect to each other by establishing contact between an end of the member and the outer surface of the shaving head, and immersing the member in a quantity of fluid, it is achieved that fluid which is present inside the tube-shaped member is separated from fluid which is present outside of the tube-shaped member. When dimensions of a cross-section of the tube-shaped member, at the end of the tube-shaped member which serves for contacting the outer surface of the shaving head, are smaller than dimensions of the contacting surface, it is possible to achieve that only a portion of the contacting surface is covered by the tube-shaped member, whereas another portion is left free. For example, the tube-shaped member may be used to separate a central portion of the contacting surface from an annular portion surrounding the central portion, namely by putting the tube-shaped member in a central position with respect to the contacting surface. The cross-section of the tube-shaped member may have any suitable shape, but a circular shape is preferred.

In particular, the separating means may comprise a tube-shaped bellows, which comprises a flexible material such as rubber. When the bellows is immersed in a quantity of fluid, and contact between an end of the bellows and the outer surface of the shaving head is established, at a side of the shaving head where the contacting surface is located, the bellows allows for well-controllable positioning of the contacting surface with respect to a fluid level.

In order to ensure excellent cleaning results, it is advantageous if the cleaning unit according to the present invention comprises filtering means. According to the present invention, separating means are applied, so that an incoming flow of cleaning fluid and an outgoing flow of cleaning fluid can be separated. During a cleaning process, the incoming flow of fluid is kept free from hairs and other particles removed from the interior space of the shaving head when filtering means are positioned in the incoming flow. It is an important advantage of the present invention that the application of the separating means leads to a separation of an incoming flow and an outgoing flow, as by virtue of this fact, it is easy to prevent hairs and dirt particles which are taken along by the outgoing flow from reaching the interior space of the shaving head again, which is achieved by simply applying filtering means and positioning these means in the incoming flow.

When the separating means have two open ends, which is the case when the separating means comprise a tube-shaped member, it is advantageous if the filtering means are arranged at one of the open ends, in particular another open end than the open end which serves for contacting the outer surface of the shaving head. During a cleaning process, when cleaning fluid is supplied to the shaving head through the tube-shaped member, dirt particles are removed from the cleaning fluid flowing into the tube-shaped member by the filtering means.

The cleaning unit according to the present invention may be applied for subjecting any type of shaving head to a cleaning process, regardless of the shape of the contacting surface. For example, the contacting surface may comprise at least one annular corrugation. In a case in which the contacting surface comprises at least two concentrically arranged annular corrugations, it is advantageous if the separating means are adapted to constitute a physical barrier between at least one inner annular corrugation and at least one outer annular corrugation. In this way, it is possible to achieve that a central portion of the contacting surface, where an incoming flow is realized under the influence of a pump action which is obtained when the cutter member of the shaving head is moved, is separated from an annular portion surrounding the central portion, where an outgoing flow is realized.

In a preferred embodiment of the cleaning unit according to the present invention, the separating means are resiliently mounted, so that when contact between the separating means and the outer surface of the shaving head is established, it is still possible to vary a position of the shaving head, which may be very useful in a process of putting the contacting surface of the shaving head in a proper position with respect to a fluid level.

In a practical embodiment, the cleaning unit according to the present invention comprises a container for containing cleaning fluid, the separating means being at least partially arranged in the container, and a side of the separating means which serves for contacting the outer surface of the shaving head being an upper side, as seen in relation to a bottom of the container. When a cleaning process needs to be performed, the container is filled with cleaning fluid, and contact between the separating means and the outer surface of the shaving head to be cleaned is established. When a pump action is realized, a rinsing flow of the cleaning fluid is obtained, such that the cleaning fluid is continuously forced to flow from the container into the interior space of the shaving head, through the separating means, and back into the container or another receptacle. It is preferred that the side of the separating means which serves for contacting the outer surface of the shaving head is movably arranged with respect to the bottom of the container, as in such a case, the advantage of allowing for a proper positioning of the contacting surface with respect to a fluid level in the container is achieved.

In one of many possible embodiments, the cleaning unit according to the present invention further comprises valve means having two valve elements which are movably arranged with respect to each other, one of the valve elements comprising at least one hole for letting through fluid, and another of the valve elements being adapted to cover a side of the valve element comprising the at least one hole when the valve elements are put in a position in which these elements are contacting each other.

For the purpose of having a pump action, the shaving head needs to be filled with fluid, as it is not possible to achieve a sufficiently powerful centrifugal pump action in air. By using the valve means, it is possible to realize an initial filling of the shaving head without the need of exposing more of the outer surface of the shaving head than the contacting surface of the cap to the cleaning fluid. This is desirable in view of the fact that other portions of the outer surface of the shaving head may have a low resistance to harmful effects of the cleaning fluid, which is especially relevant when a cleaning fluid other than water, for example a cleaning fluid containing alcohol, is used.

When the valve elements are put in a contacting position, it is possible to position the contacting surface of the shaving head below the level of the fluid in order to allow the shaving head to be filled with the fluid. In that case, the fluid is supplied through the valve element covering the valve element having the at least one hole, while the second valve element may be adapted to prevent the fluid from reaching portions of the shaving head which are outside of the area where the flow of fluid through the first valve element takes place. Preferably, both valve elements are tube-shaped, and are arranged in a coaxial fashion.

When the contacting surface of the shaving head is moved to above the fluid level, there is no longer a need for the first valve element to cover the at least one hole in the second valve element. Therefore, the valve elements may be spaced apart, and cleaning fluid which is supplied to the shaving head through the first valve element is discharged through the at least one hole in the second valve element.

Preferably, the valve element having the at least one hole is mounted on resilient means, and the valve elements are interconnected through resilient means, so that it is possible to have a default position of a side of the first valve element for contacting the outer surface of the shaving head which is above the fluid level, while the at least one opening in the second valve element is freely accessible. The valve means are brought to a closed condition and the contacting surface of the cap of the shaving head is temporarily put in a position for realizing an initial filling of the shaving head by simply pressing the shaving head in a direction opposite to the direction of action of the resilient means. It is noted that the resilient means may comprise a coil spring or another suitable spring.

In another embodiment, the cleaning unit according to the present invention does not comprise the above-described valve means, but comprises other means for allowing for an initial filling of the shaving head without wetting a portion of the outer surface of the shaving head other than the portion of the contacting surface of the shaving head which is covered by the separating means. This embodiment is equipped with a member which is arranged in the container, and which has at least one hole for letting fluid pass to the separating means, wherein means which are movable between a closed position and opened positions, and which are adapted to closing off the at least one hole in the closed position are provided, and wherein the member is closely surrounded by the separating means.

In particular, the member having the at least one hole may be a disc-shaped member, and the means for closing off the hole may comprise a lid for covering the hole. On the basis of the fact that the member is closely surrounded by the separating means, an interior volume of the separating means, which is partially filled with fluid, is initially closed off to a certain extent. Therefore, it is possible to obtain a difference between the fluid level inside the separating means and outside of the separating means, and to supply the fluid for initially filling the shaving head only through the separating means. For example, this may be realized by applying separating means which are movably arranged with respect to the disc-shaped member, and which are having two compartments, wherein an inner diameter of a compartment which is at a lowest level in a normal operational position of the cleaning unit is larger than an inner diameter of a compartment which is at a highest level. In such a case, when a shaver is pressed against the separating means, the separating means move in a downward direction, i.e. in a direction toward the bottom of the container. When this movement is continued until the water level reaches the compartment having the relatively small inner diameter, the water is forced to flow in an upward direction in the separating means from that moment on, due to the difference of the inner diameters of the compartments. Hence, in this embodiment of the cleaning unit, an additional, initial pump action is realized on the basis of a downward movement of the shaver, wherein the shaver causes the separating means to move downward as well.

For sake of completeness, it is noted that the separating means do not necessarily need to comprise two compartments having different inner diameters for achieving the above-described effect of pumping fluid towards the shaving head under the influence of a downward movement of the separating means caused by a downward movement of the shaver when the shaver is pressed against the separating means. It is also possible that the separating means have a tapered shape, for example, wherein the inner diameter of the separating means is smaller at a higher level than at a lower level. The desired downward movement of the shaver may be caused by a user of both the shaver and the cleaning unit, but may also be automatically performed by a unit for receiving and holding the shaver, in case such a unit is present.

In the separating means having portions of different inner diameter, it is possible to have means which are arranged inside the separating means, and which are movable between a closed position and opened positions. For example, the means comprise a hingeably arranged lid which is capable of covering a hole between the portions of the separating means. In this configuration, it is possible to have a free flow of fluid through the separating means, namely when the lid is in an opened position, and to block fluid communication between the portions of the separating means, namely when the lid is in the closed position. On the basis of the blocking capacity of the lid, it is possible to close off a higher compartment of the separating means and to keep fluid inside this compartment, which is suitable to be used in a following operation of the cleaning unit during the initiation of a pump action by the cutter member of the shaving head to be cleaned. As soon as such a pump action is a fact, the lid which is arranged in the separating means for separating two portions of the separating means is kept in an opened position under the influence of a suction force, so that fluid may freely flow though the separating means.

According to the present invention, for the purpose of cleaning the shaving heads of a shaver having more than one shaving head, which cleaning processes of the various shaving heads may take place simultaneously, a cleaning device comprising at least two cleaning units as described in the foregoing is provided. Consequently, the cleaning device according to the present invention comprises at least two separating means, each of the separating means being intended to contact the outer surface of another shaving head. This device is especially suitable for cleaning shaving heads of a shaver in which each of the shaving heads has a separate hair chamber, i.e. a shaver in which there is no common hair chamber for collecting hairs from all the shaving heads, as in this case, a proper centrifugal pump action may be realized when the cutter members of the various shaving heads are operated. That does not alter the fact that the cleaning device according to the present invention is also suitable to be used in combination with other types of shavers, for example a shaver having at least two shaving heads and a single, shared hair chamber.

In a particular embodiment of the cleaning device, which is preferred in case the cleaning units are adapted to function with a variable level of a side of the separating means which serves for contacting the outer surface of a shaving head, the separating means of the various cleaning units are supported by a common element adapted to allow for a movement of the separating means in the device. A required movement of the separating means of the various cleaning units is realized by operating the common element in an appropriate fashion, which is easier than operating various supporting elements. Moreover, it is relatively easy to realize corresponding movements of the separating means of the various cleaning units when a common element is applied. The common element may comprise a tube-shaped bellows, for example, which is suitable for both allowing for a variation in a position of the separating means of the cleaning units in the cleaning device and conveying fluid to the separating means.

The above-described and other aspects of the present invention will be apparent from and elucidated with reference to the following description of six embodiments of a cleaning unit according to the present invention.

BRIEF DESCRIPTION OF THE DRAWINGS

The present invention will now be explained in greater detail with reference to the Figures, in which equal or similar parts are indicated by the same reference signs, and in which.

DETAILED DESCRIPTION OF EMBODIMENTS

Figure 1:
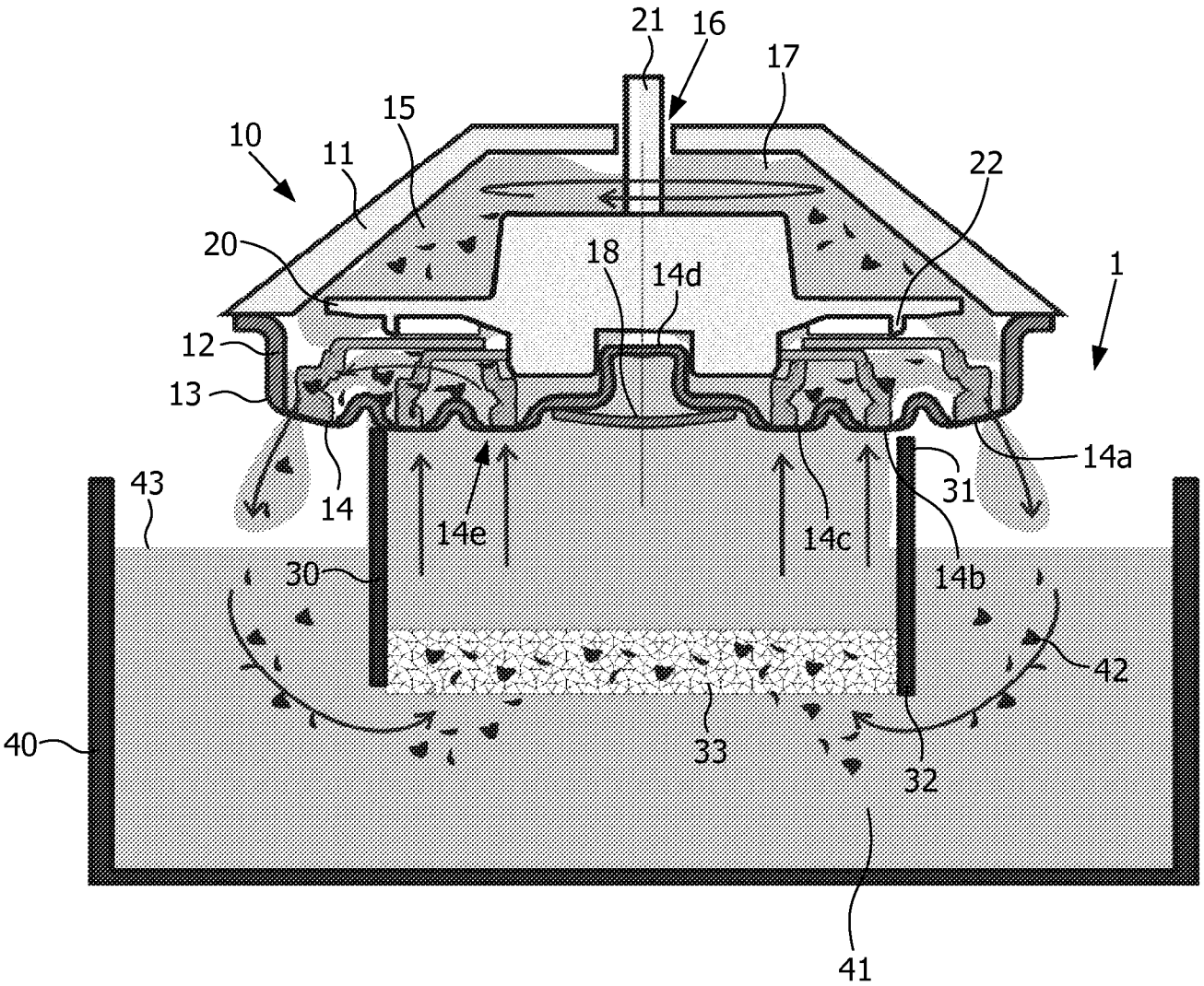
FIG. 1 diagrammatically shows a side view of a cross-section of a shaving head of a shaver and a cleaning unit according to a first preferred embodiment of the present invention.

FIG. 1 diagrammatically shows a side view of a cross-section of a shaving head 10 of a shaver (not shown in its entirety) and a cleaning unit 1 according to a first preferred embodiment of the present invention.

The shaving head 10 comprises a bowl-shaped base element 11 and a cap 12 for closing off the base element 11. A portion of an outer surface 13 of the shaving head 10 is a contacting surface 14 for contacting a portion of skin to be shaved, which, in the shown example, is part of the cap 12. In an interior space 15 of the shaving head 10, i.e. a space 15 which is enclosed by the base element 11 and the cap 12, a rotatably arranged cutter member 20 is arranged, and a drive shaft 21 of the cutter member 20 extends through a central hole 16 in the base element 11. The cutter member 20 comprises a plurality of cutters 22 which are adapted to cutting through hair. For the purpose of catching hairs when the shaving head is moved along a portion of skin and letting the hairs into the interior space 15 of the shaving head 10, the cap 12 is provided with a plurality of holes (not shown). In order to achieve proper shaving results, the cap 12 is relatively thin, and the cutters 22 of the cutter member 20 are positioned right behind the cap 12.

A portion of the interior space 15 of the shaving head 10, in particular the portion which is present between the cutter member 20 and the base element 11, serves for receiving hairs which are cut off by the cutter member 20. In view of this, this portion of the interior space 15 is also referred to as hair chamber 17.

The contacting surface 14 of the shaving head 10 may have any suitable shape. In the shown example, the contacting surface 14 comprises three concentrically arranged annular corrugations 14*a*, 14*b*, 14*c* and a recessed central portion 14*d*, which is closed off by a cover 18.

According to an insight underlying the present invention, the shaving head 10 as shown is capable of acting like a centrifugal pump for causing a displacement of fluid. Among other things, the pumping effect which may be realized by means of the shaving head 10 is obtained on the basis of the fact that the interior space 15 of this shaving head 10 is relatively small. When the shaving head 10 as shown in FIG. 1 is immersed in a quantity of fluid, and the cutter member 20 is rotated, pressure is built up in the interior space 15 of the shaving head 10, and fluid is sucked in through a central portion of the cap 12, and is forced to flow out of the interior space 15 of the shaving head 10 at an annular portion surrounding the central portion.

The capability of the shaving head 10 to act as a centrifugal pump for pumping fluid is a useful feature in view of the need of regularly subjecting the shaving head 10 to a cleaning process, assuming normal use of the shaver of which the shaving head 10 is part. Without any further modifications or applications of further means, it is possible to rinse interior space 15 of the shaving head 10 with a cleaning fluid, simply by putting the shaving head 10 into contact with a quantity of cleaning fluid and driving the cutter member 20.

For the purpose of cleaning the interior space 15 of the shaving head 10, it is desirable not just to provide a container containing a quantity of cleaning fluid, immersing the shaving head 10 in the fluid, and driving the cutter member 20 in order to realize the centrifugal pump action of the shaving head 10, for several reasons. In the first place, it is true that the more of the shaving head 10 is put into contact with the cleaning fluid, the longer it takes to dry the shaving head 10. In the second place, elements of the shaver surrounding the shaving head 10 may be sensitive to the cleaning fluid, and may even get affected by the cleaning fluid.

The present invention proposes a solution which is found in only letting a central portion 14*e* of the contacting surface 14 come into contact with an ingoing flow of cleaning fluid. In particular, the cleaning unit 1 according to the present invention as shown in FIG. 1 comprises a separating tube 30, dimensions of a cross-section of the separating tube 30 being smaller than dimensions of the contacting surface 14 of the shaving head 10. When the shaving head 10 and the separating tube 30 have a mutual position as shown in FIG. 1, i.e. a position in which an end of the separating tube 30 contacts the contacting surface 14 of the shaving head 10, and in which central axes of the shaving head 10 and the separating tube 30 coincide, it is possible to achieve that a supply of cleaning fluid only takes place through the separating tube 30, while a discharge of cleaning fluid takes place through an annular portion of the cap 12 which is left free by the separating tube 30.

Important elements of the cleaning unit 1 according to the present invention are a container 40 for containing a quantity of cleaning fluid 41 and the separating tube 30 as described in the foregoing. In the following, the end of the separating tube 30 which serves for contacting the contacting surface 14 of the shaving head 10 will be referred to as outlet end 31, and another end of the separating tube 30 will be referred to as inlet end 32. In the shown example, dimensions of a cross-section of the separating tube 30 are constant along a length of the tube 30, the dimensions of the cross-section of the tube 30 being such that the tube 30 is capable of covering two inner annular corrugations 14*b*, 14*c* and the recessed central portion 14*d* of the contacting surface 14 of the shaving head 10. With respect to the cleaning fluid 41, it is noted that this fluid 41 may be any suitable fluid for cleaning the interior space 15 of the shaving head 10.

When the shaving head 10 is put in place against the outlet end 31 of the separating tube 30, and the cutter member 20 of the shaving head 10 is rotated, while the interior space 15 of the shaving head 10 is filled with cleaning fluid 41 and is in fluid communication with the cleaning fluid 41 in the container 40, through the separating tube 30, a flow of the cleaning fluid 41 is realized under the influence of a centrifugal pump action of the shaving head 10. The flow which is generated is such that cleaning fluid 41 flows through the separating tube 30, from the inlet end 32 to the outlet end 31, through the holes in the cap 12 of the shaving head 10, through the interior space 15 of the shaving head 10, exits the interior space 15 of the shaving head 10 through the holes in an annular portion of the cap 12 of the shaving head 10, outside of the area where the contacting surface 14 is covered by the separating tube 30, and is received by the container 40. In the process, cut-off hairs and other dirt particles are taken along with the cleaning fluid 41, and the interior space 15 of the shaving head 10 is cleaned. In FIG. 1, a direction of the flow of cleaning fluid 41 is indicated by means of arrows. A rotation motion of the cutter member 20 is indicated by means of an arrow as well. The cut-off hairs and dirt particles are represented by a number of small spots which are indicated by means of reference numeral 42.

The cleaning unit 1 according to the present invention comprises a filter 33 which is positioned in the separating tube 30, such that an outer circumference of the filter 33 contacts an inner circumference of the separating tube 30. In the shown example, the filter 33 is positioned at the inlet end 32 of the separating tube 30. By virtue of the application of the filter 33, the effect of the cleaning process is enhanced, as the filter 33 prevents the cut-off hairs and dirt particles 42 which have been removed from the interior space 15 of the shaving head 10 from reaching the shaving head 10 again.

In order to ensure that of the entire outer surface 13 of the shaving head 10, only the central portion 14*e* of the contacting surface 14 of the shaving head 10, which is covered by the separating tube 30, is wetted by the cleaning fluid 41, it is preferred that the contacting surface 14 is kept at a level above the level of the fluid 41 during a cleaning process. In such a case, the centrifugal pump action of the shaving head 10 is capable of realizing a high enough suction force for sucking up the cleaning fluid 41. An example of a proper position of the shaving head 10 with respect to a fluid level 43 is shown in FIG. 1. In a practical embodiment, the cleaning unit 1 according to the present invention may comprise means for holding the separating tube 30. For the sake of simplicity, such means are not shown in FIG. 1.

Figure 2:
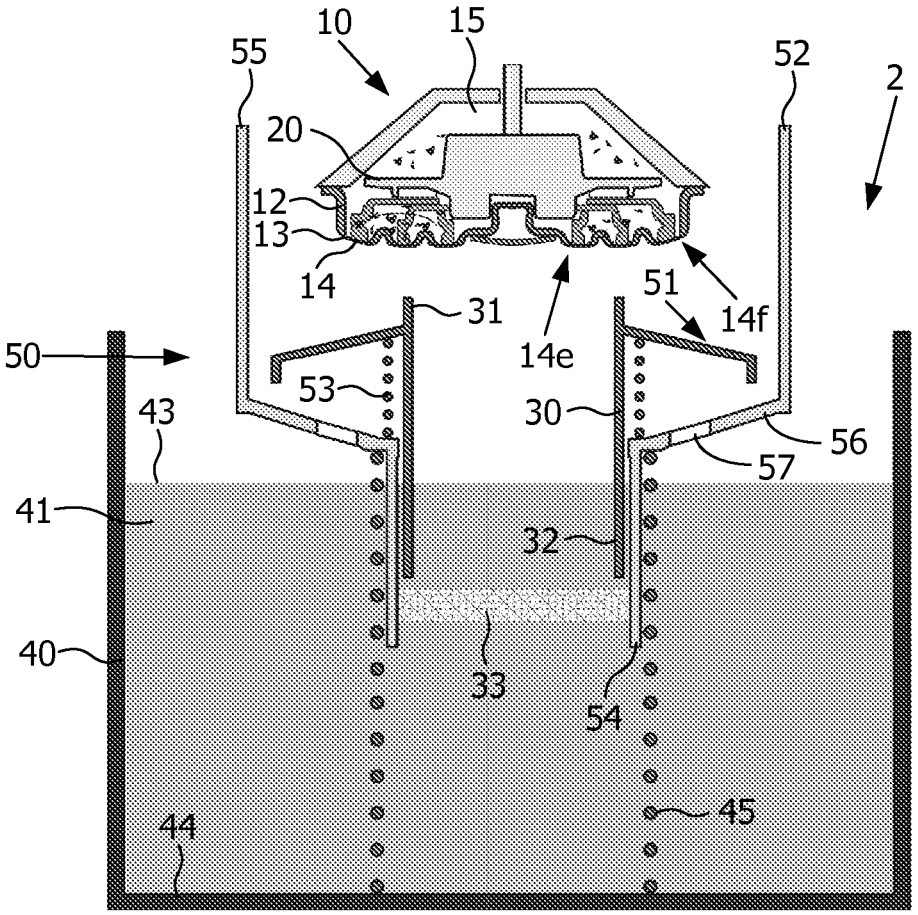
FIG. 2 diagrammatically shows a side view of a cross-section of a shaving head of a shaver and a cleaning unit according to a second preferred embodiment of the present invention, in a situation in which the shaving head is about to contact a component of the cleaning unit.
Figure 3:
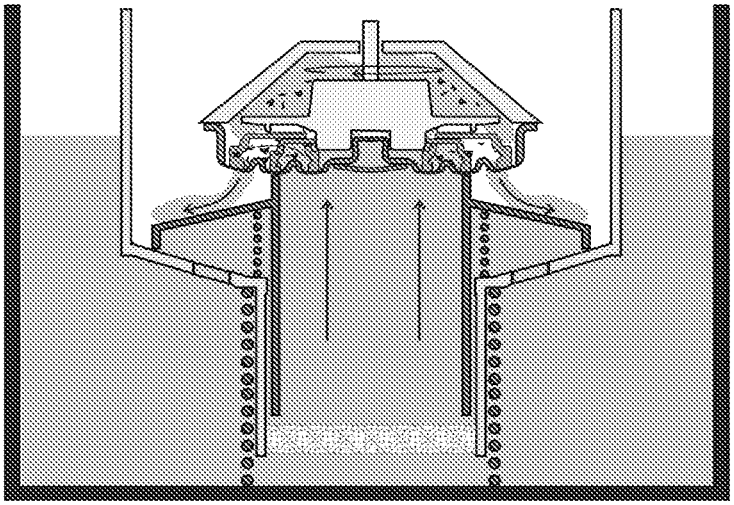
FIG. 3 diagrammatically shows the shaving head and the cleaning unit as shown in FIG. 2, in a situation in which initial filling of an interior space of the shaving head with cleaning fluid takes place.
Figure 4:
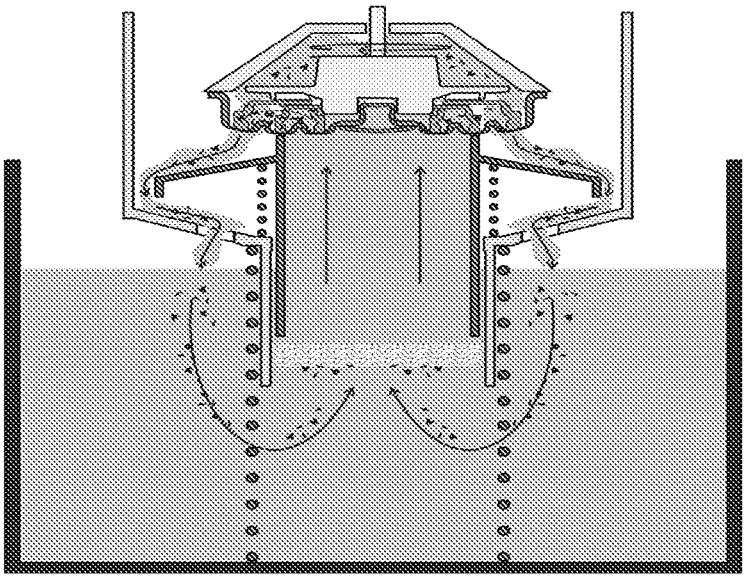
FIG. 4 diagrammatically shows the shaving head and the cleaning unit as shown in FIGS. 2 and 3, during a cleaning process.

In order to achieve a centrifugal pump action of the shaving head 10, it is important to have the shaving head 10 filled with cleaning fluid 41. As it is desired to keep portions of the outer surface 13 other than the central portion 14*e* of the contacting surface 14 dry, it is not preferred to simply immerse the shaving head 10 in the quantity of cleaning fluid 41 for the purpose of realizing an initial filling of the shaving head 10. Therefore, an embodiment of the cleaning unit according to the present invention is proposed, in which it is possible to initially bring the contacting surface 14 of the shaving head 10 below the fluid level 43 in order to have the shaving head 10 filled with the cleaning fluid 41, without wetting portions of the outer surface 13 of the shaving head 10 other than the central portion 14*e* of the contacting surface 14, which is covered by the separating tube 30. This embodiment is shown in FIGS. 2-4, and will be referred to as second preferred embodiment of the present invention.

Like the cleaning unit 1 according to the first preferred embodiment of the present invention, the cleaning unit 2 according to the second preferred embodiment of the present invention comprises a container 40 for containing cleaning fluid 41 and a separating tube 30 having an inlet end 32 and an outlet end 31, which outlet end 31 serves for contacting the contacting surface 14 which is a portion of an outer surface 13 of a shaving head 10, and which is part of a cap 12 of the shaving head 10.

Furthermore, the cleaning unit 2 according to the second preferred embodiment of the present invention comprises a valve device 50 having two valve elements 51, 52 which are displaceable with respect to each other, and which are interconnected by means of a coil spring 53, the first valve element 51 being an annular element 51 which encompasses the separating tube 30 at a position near the outlet end 31 of the separating tube 30, and the second valve element 52 being an element 52 having two tube-shaped sections 54, 55 of different inner diameters, and a section 56 for interconnecting the tube-shaped sections 54, 55.

The second valve element 52 has at least one fluid outlet hole 57, which is provided in the interconnecting section 56. Furthermore, the second valve element 52 is supported at a bottom 44 of the container 40, by a coil spring 45 extending between the bottom 44 of the container 40 and the outer surface of the second valve element 52, at a transition area of a tube-shaped section 54, which is nearest to the bottom 44 of the container 40, to the interconnecting section 56. Dimensions of a cross-section of the tube-shaped section 54 which is nearest to the bottom 44 of the container 40 are smaller than dimensions of a cross-section of the other tube-shaped section 55. In the following, the first tube-shaped section 54 is referred to as bottom tube-shaped section 54, and the latter tube-shaped section 55 is referred to as top tube-shaped section 55.

A filter 33 of the cleaning unit 2 is arranged at an end of the bottom tube-shaped section 54 of the second valve element 52. The valve elements 51, 52 are concentrically arranged, and a portion of the separating tube 30 is closely surrounded by the bottom tube-shaped section 54.

A cleaning process of a shaving head 10, which is performed by means of the cleaning unit 2 as shown in FIGS. 2-4, comprises a number of steps.

In a default situation, i.e. a situation in which the springs 45, 53 are free from compression, the outlet end 31 of the separating tube 30 is above the fluid level 43, and there is no contact between the valve elements 51, 52. This situation is shown in FIG. 2.

In the first place, the shaving head 10 is arranged in a proper position with respect to the separating tube 30, in which the contacting surface 14 of the shaving head 10 is contacted by the outlet end 31 of the separating tube 30, and in which the central portion 14*e* of the contacting surface 14 is closed off from an annular portion 14*f* by the separating tube 30. Furthermore, the shaving head 10 is pressed towards the bottom 44 of the container 40. In the process, both springs 45, 53 are compressed, so that the outlet end 31 of the separating tube 30 gets below the fluid level 43, and contact between the valve elements 51, 52 is established. As a result of the fact that the outlet end 31 of the separating tube 30 is below the fluid level 43, the separating tube 30 is filled completely with the cleaning fluid 41, and the cleaning fluid 41 also reaches the interior space 15 of the shaving head 10. In this situation, which is shown in FIG. 3, a centrifugal pump action of the shaving head 10 to the cleaning fluid 41 is obtained, provided that the cutter member 20 of the shaving head 10 is rotated. In the process, the cleaning fluid 41 is only supplied through the separating tube 30, as the at least one hole 57 in the interconnecting section 56 of the second valve element 52 is closed off by means of the first valve element 51.

As soon as the pump action is initiated, the shaving head 10 is retracted, while contact between the shaving head 10 and the separating tube 30 is maintained. Eventually, a configuration of the cleaning unit 2 and the shaving head 10 as shown in FIG. 4 is obtained, which is the same as the configuration in the default situation, wherein the centrifugal pump action of the shaving head 10 is maintained by ensuring that a fluid connection between fluid 41 in the shaving head 10 and fluid 41 in the container 40 is maintained, and wherein this pump action is strong enough for sucking up the fluid 41.

During a cleaning process which is performed by the cleaning unit 2 according to the second preferred embodiment of the present invention, the cleaning fluid 41 flows through the separating tube 30, from the inlet end 32 to the outlet end 31 of the separating tube 30, passes the cap 12 of the shaving head 10, flows through the interior space 15 of the shaving head 10, exits the interior space 15 of the shaving head 10 through a portion of the cap 12 which surrounds the central portion of the cap 12 where the incoming flow is, flows along the first valve element 51, reaches the interconnecting section 56 of the second valve element 52, and flows back into the container 40 through the at least one fluid outlet hole 57 in the second valve element 56. For the sake of clarity, in FIGS. 3 and 4, a direction of the flow of cleaning fluid 41 is indicated by means of arrows. A rotation motion of the cutter member 20 is indicated by means of an arrow as well.

Figure 5:
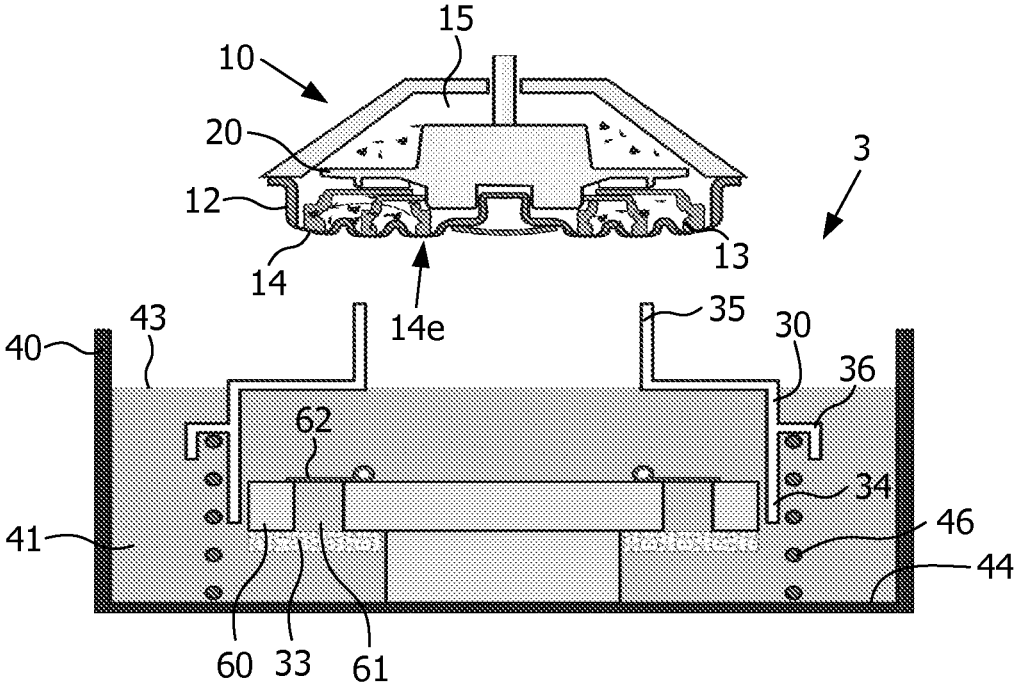
FIG. 5 diagrammatically shows a side view of a cross-section of a shaving head of a shaver and a cleaning unit according to a third preferred embodiment of the present invention, in a situation in which the shaving head is about to contact a component of the cleaning unit.
Figure 6:
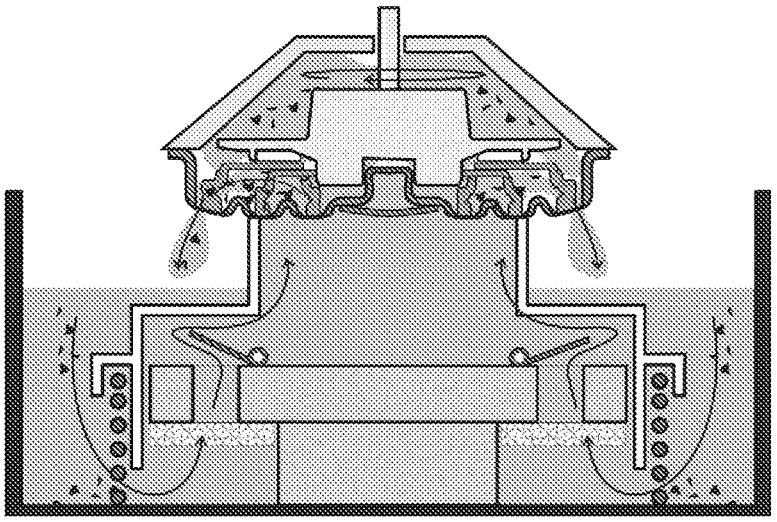
FIG. 6 diagrammatically shows the shaving head and the cleaning unit as shown in FIG. 5, during a cleaning process.
Figure 7:
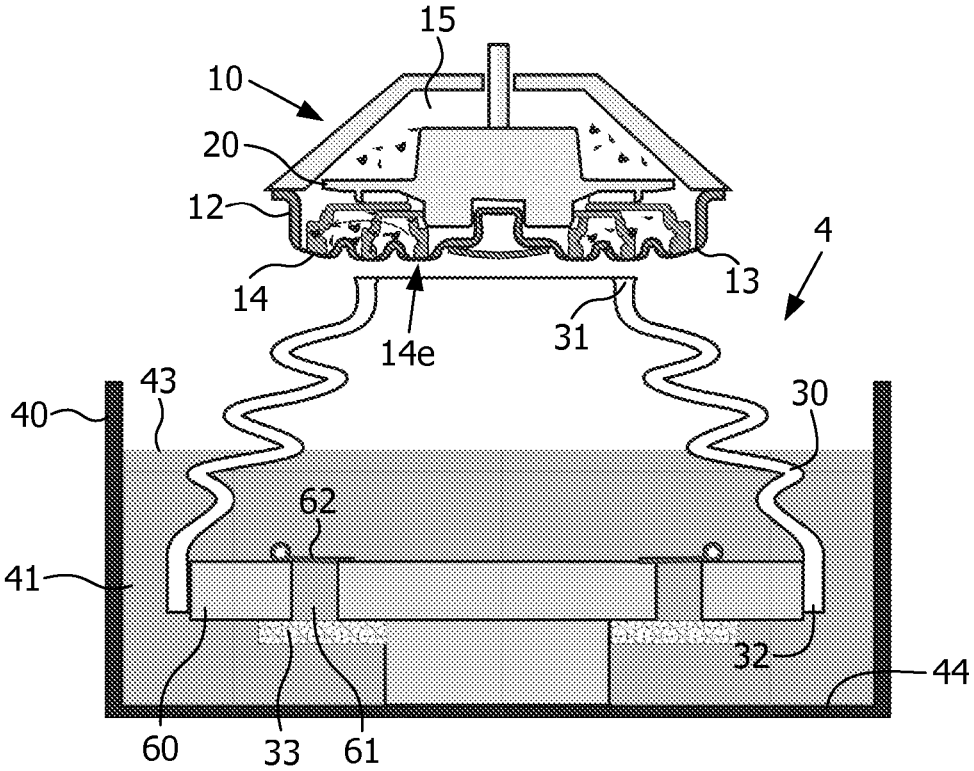
FIG. 7 diagrammatically shows a side view of a cross-section of a shaving head of a shaver and a cleaning unit according to a fourth preferred embodiment of the present invention, in a situation in which the shaving head is about to contact a component of the cleaning unit.
Figure 8:
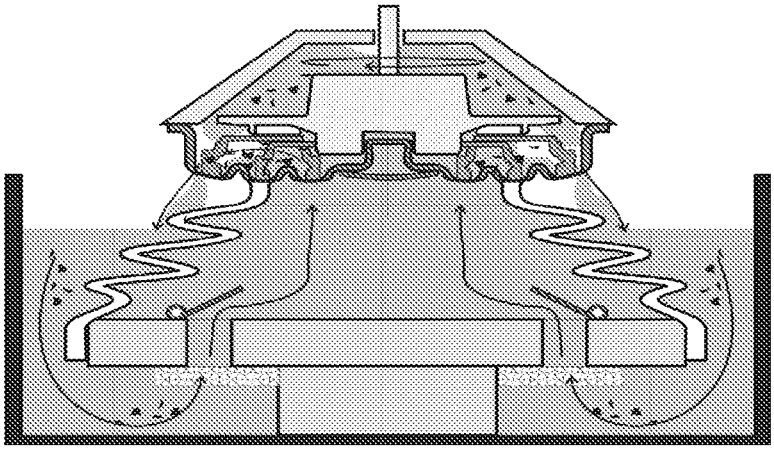
FIG. 8 diagrammatically shows the shaving head and the cleaning unit as shown in FIG. 7, during a cleaning process.

FIGS. 5 and 6, FIGS. 7 and 8, and FIGS. 9-12, respectively, show three other embodiments of the cleaning unit according to the present invention, in which it is possible to initially fill the shaving head 10 with cleaning fluid 41, without wetting portions of the outer surface 13 of the shaving head 10 other than the central portion 14*e* of the contacting surface 14, which is covered by the separating tube 30. The embodiment which is shown in FIGS. 5 and 6 is referred to as third preferred embodiment of the present invention, the embodiment which is shown in FIGS. 7 and 8 is referred to as fourth preferred embodiment of the present invention, and the embodiment which is shown in FIGS. 9-12 is referred to as fifth preferred embodiment of the present invention.

Like the hitherto described cleaning units 1, 2, the cleaning unit 3 according to the third preferred embodiment of the present invention comprises a container 40 filled with cleaning fluid 41, and a separating tube 30. In this particular cleaning unit 3, the separating tube 30 has two sections 34, 35 of different inner diameter, i.e. a lower tube section 34, which is positioned closest to the bottom 44 of the container 40, has a larger inner diameter than an upper tube section 35. The separating tube 30 is resiliently mounted on the bottom 44 of the container 40 by means of a coil spring 46.

Furthermore, the cleaning unit 3 according to the third preferred embodiment of the present invention comprises a disc-shaped member 60, which is closely surrounded by the lower section 34 of the separating tube 30. The disc-shaped member 60 is positioned at a distance from the bottom 44 of the container 40, and comprises at least one hole 61, and at least one hingeably arranged lid 62 for covering the hole 61, this lid 62 being arranged at a side of the disc-shaped member 60 facing away from the bottom 44 of the container 40. In particular, the lid 62 is movable between a closed position for preventing a flow of fluid 41 through the hole 61, and opened positions for allowing for such a flow. In a default position as shown in FIG. 5, the lid 62 is in a closed position. Like the hitherto described cleaning units 1, 2, the cleaning unit 3 according to the third preferred embodiment of the present invention comprises at least one filter 33. In this case, the filter 33 is arranged such as to cover a portion of a side of the disc-shaped member 60 facing the bottom 44 of the container 41, such that at least the hole 61 in the disc-shaped member 60 is covered.

When the cleaning unit 3 according to the third preferred embodiment of the present invention is applied, initial filling of a shaving head 10 to be cleaned takes place in the following manner. It is noted that in an initial situation, the container 40 is filled with a quantity of cleaning fluid 41, such that a fluid level 43 is above a level at which the disc-shaped member 60 is positioned.

In the first place, the cutter member 20 of the shaving head 10 is driven such as to rotate. In the second place, the shaving head 10 is pressed onto the separating tube 30. In the process, the spring 46 extending between a connection position 36 on the separating tube 30 and the bottom 44 of the container 40 is compressed. Due to the fact that the lower section 34 of the separating tube 30 closely surrounds the disc-shaped member 60, and the fact that the inner diameter of the lower section 34 is larger than the inner diameter of the upper section 35, the fluid 41 that is present in the separating tube 30 rises to a higher level than the fluid 41 that is present outside of the separating tube 30. As soon as the fluid 41 in the separating tube 30 reaches the interior space 15 of the shaving head 10, a centrifugal pump action on the fluid 41 is realized under the influence of the rotation motion of the cutter member 20 of the shaving head 10, and a flow of fluid 41 through the interior space 15 is obtained. Under the influence of the centrifugal pump action, the lid 62 of the disc-shaped member 60 is brought to an opened position, so that fluid 41 may freely reach an interior volume of the separating tube 30, through the hole 61. The situation thus obtained, in which the interior space 15 of the shaving head 10 is subjected to a rinsing process, is illustrated in FIG. 6. For the sake of clarity, in FIG. 6, a direction of the flow of cleaning fluid 41 is indicated by means of arrows. A rotation motion of the cutter member 20 is indicated by means of an arrow as well.

An advantage of the application of the cleaning unit 3 according to the third preferred embodiment of the present invention is that opening the hole 61 for letting through fluid 41 to the interior volume of the separating tube 30 does not require a refraction of the shaving head 10, as is the case in the above-described cleaning unit 2 according to the second preferred embodiment of the present invention. The reason is found in the application of the lid 62 for covering the hole 61, which is brought to an opened position as soon as it is subjected to a centrifugal pump action.

It is noted that within the scope of the present invention, it is not necessary to apply a hingeably arranged lid 62 as shown for covering the hole 61, and that other means may be applied, for example a ball or a membrane.

The cleaning unit 4 according to the fourth preferred embodiment of the present invention resembles the cleaning unit 3 according to the third embodiment of the present invention to a considerable extent. In the cleaning unit 4 according to the fourth preferred embodiment of the present invention, the spring 46 for mounting the separating tube 30 on the bottom 44 of the container 40 is omitted. Instead, the separating tube 30 itself is a resilient element. In the shown example, the separating tube 30 is designed to be a bellows comprising a flexible material such as rubber, the bellows having a somewhat tapering shape, such that a diameter at an outlet end 31 is smaller than a diameter at an inlet end 32.

When the cleaning unit 4 according to the fourth preferred embodiment of the present invention is applied for the purpose of cleaning a shaving head 10, and the shaving head 10 is pressed onto the separating tube 30, the separating tube 30 is compressed, and fluid 41 is supplied to the interior space 15 of the shaving head 10, through the separating tube 30, while portions of the outer surface 13 of the shaving head 10 which are not covered by the separating tube 30 remain dry. As is the case with the other shown cleaning units 1, 2, 3, a cleaning process of the interior space 15 of the shaving head 10 is carried out when the cutter member 20 of the shaving head 10 is rotated for obtaining a centrifugal pump action. A situation in which the cleaning process takes place is illustrated in FIG. 8, wherein a direction of the flow of cleaning fluid 41 is indicated by means of arrows. In the Figure, a rotation motion of the cutter member 20 is indicated by means of an arrow as well.

Figure 9:
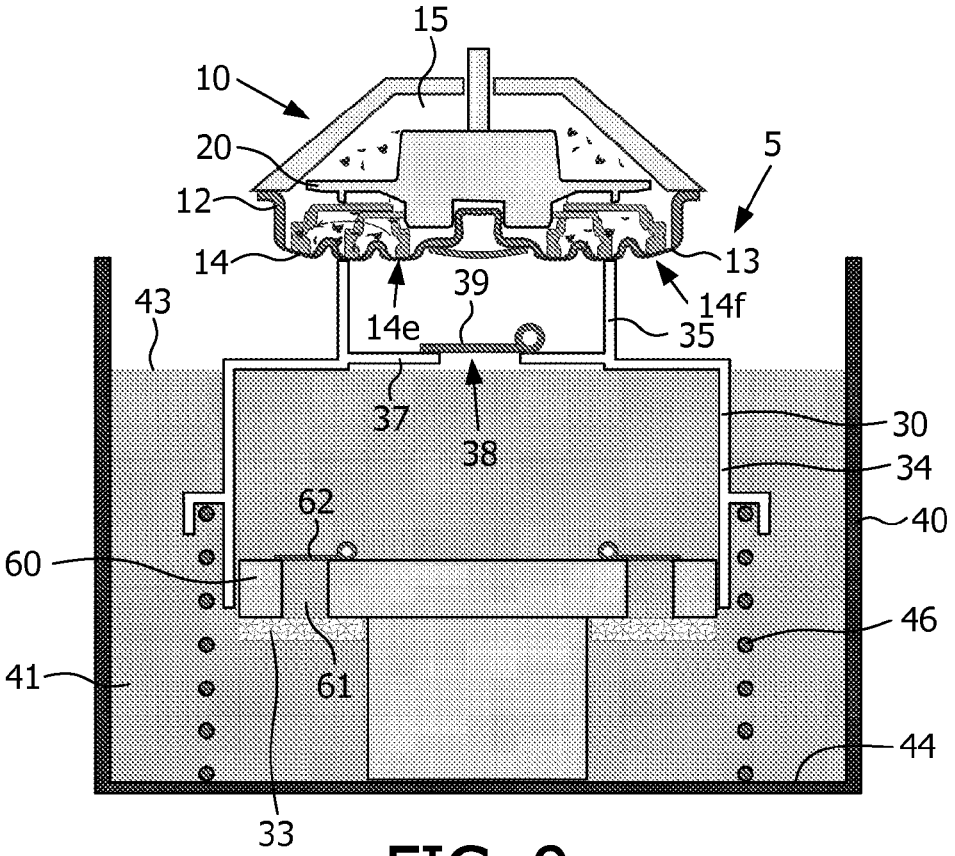
FIG. 9 diagrammatically shows a side view of a cross-section of a shaving head of a shaver and a cleaning unit according to a fifth preferred embodiment of the present invention, in a situation of first use of the cleaning unit and initial positioning of the shaving head with respect to the cleaning unit.

Like the cleaning unit 4 according to the fourth preferred embodiment of the present invention, the cleaning unit 5 according to the fifth preferred embodiment of the present invention resembles the cleaning unit 3 according to the third preferred embodiment of the present invention to a large extent. When a comparison is made, it appears that the proportions are somewhat different, and that the cleaning unit 5 according to the fifth preferred embodiment of the present invention has an extra feature, namely a separation wall 37 located between the sections 34, 35 of the separating tube 30. In the separation wall 37, a hole 38 is present, wherein a hingeably arranged lid 39 is provided for covering the hole 38, this lid 39 being arranged at a side of the separation wall 37 facing away from the bottom 44 of the container 40. In particular, the lid 39 is movable between a closed position for preventing a flow of fluid 41 through the hole 38, and opened positions for allowing for such a flow. In a default position as shown in FIG. 9, the lid 39 is in a closed position. For sake of completeness, it is noted that within the scope of the present invention, any suitable means which are capable of closing the hole 38 in at least one position may be applied, and that these means do not necessarily need to comprise a hingeably arranged lid 39 as shown. For example, the means may comprise a lid 39 which is movable in a vertical direction as a whole, and which is arranged such as to be movable from the closed position to an opened position under the influence of the pressures prevailing during a pump action.

The operation of the cleaning unit 5 according to the fifth preferred embodiment of the present invention is as will be explained in the following.

Figure 10:
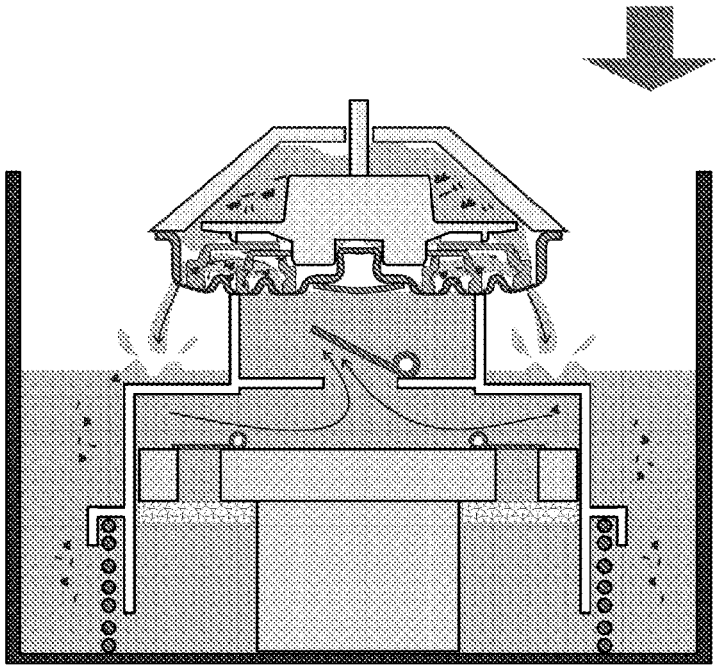
FIG. 10 and FIG. 11 diagrammatically show the shaving head and the cleaning unit as shown in FIG. 9, during a cleaning process.

In a default situation, as illustrated by FIG. 9, all lids 39, 62 which are present in the cleaning unit 5 are closed, the separating tube 30 is kept at a predetermined level with respect to the bottom 44 of the container 40 by means of the coil spring 46, and the lower tube section 34 is filled with the cleaning fluid 41, wherein inside of the separating tube 30 and outside of the separating tube 30, a level 43 of the fluid 41 is the same. When a shaving head 10 is put in place in the cleaning unit 5, i.e. when the contacting surface 14 of the shaving head 10 is put in contact with the outlet end 31 of the separating tube 30, filling of the interior space 15 takes place by exerting pressure in a downward direction, i.e. in a direction towards the bottom 44 of the container 40, under the influence of which both the shaving head 10 and the separating tube 30 are moved in the downward direction, against the action of the coil spring 46, which is compressed. In the process, the lid 39 covering the hole 38 in the separation wall 37 is pressed to an opened position, and the cleaning fluid 41 which is present inside the separating tube 30 is pressed inside the interior space 15 of the shaving head 10, through the holes in the cap 12 of the shaving head 10 which are located in the central portion **14*e* of the contacting surface 14. In FIG. 10, the downward movement of the shaving head 10 and the separating tube 30** is indicated by means of an arrow.

As has been described in the foregoing with respect to other embodiments of the cleaning unit according to the present invention, the cutter member 20 is rotated, so that a high-speed rinsing flow of cleaning fluid 41 is obtained in the interior space 15 of the shaving head 10. A flow of polluted fluid 41 exits the interior space 15 of the shaving head 10 through the holes in the cap 12 of the shaving head 10 which are present in the annular portion **14*f* of the contacting surface 14**.

Figure 11:
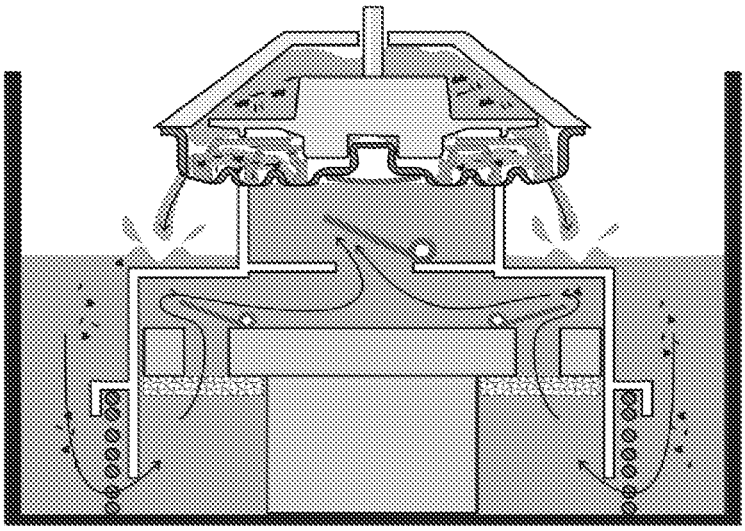

Initially, the lid 62 covering the hole 61 of the disc-shaped member 60 remains closed, and only the fluid 41 which is present inside the separating tube 30 is used, until the interior space 15 is filled with the cleaning fluid 41 to a sufficient extent, and a pump action takes place under influence of a rotation of the cutter member 20. At that point, the lid 62 is moved to an opened position under the influence of suction forces, and a fresh supply of cleaning fluid 41 is allowed to flow towards the shaving head 10. This situation is illustrated by FIG. 11.

Figure 12:
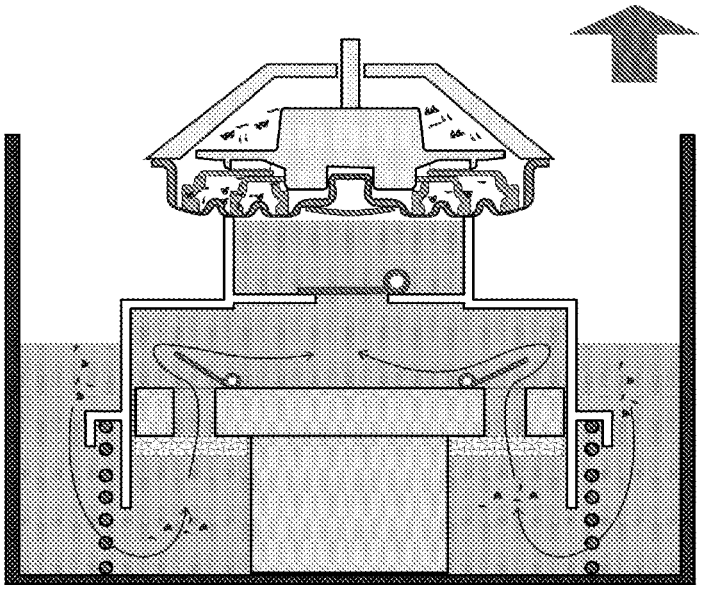
FIG. 12 diagrammatically shows the shaving head and the cleaning unit as shown in FIGS. 9-11, in a situation in which the shaving is retracted with respect to the cleaning unit.

When the shaving head 10 is retracted, a situation such as illustrated by FIG. 12 is obtained. In the Figure, a direction of the movement is indicated by means of an arrow. The retraction of the shaving head 10 is an upward movement with respect to the bottom 44 of the container 40 of the cleaning unit 5. Under the influence of the coil spring 46, the separation tube 30 performs an upward movement as well. During this movement, the lid 39 covering the hole 38 of the separation wall 37 is in the closed position, so that a quantity of cleaning fluid 41 is trapped inside the upper tube section 35. Furthermore, cleaning fluid 41 is sucked in to the lower tube section 34, through the hole 61 in the disc-shaped member 60, wherein the lid 62 is still in the opened position. The quantity of fluid 41 that is present in the separating tube 30 after the upward movement as described has taken place, is ready to be used in a following cleaning process, wherein the quantity which is present in the upper tube section 35 is immediately available. For sake of completeness, it is noted that FIG. 9 illustrates a situation of first use of the cleaning unit 5, in which only the lower tube section 34 is filled. Furthermore, it is noted that in FIGS. 10-12, for the sake of clarity, a direction of the flow of cleaning fluid 41 is indicated by means of arrows.

It follows from the above description of the way in which the cleaning unit 5 is operated that the separating tube 30 and the disc-shaped member 60 cooperate like a piston-cylinder device, which is capable of exerting suction forces and pressing forces on the fluid 41, depending on the direction in which the separating tube 30 and the disc-shaped member 60 are moved with respect to each other. On the basis of this fact, the combination of the separating tube 30 and the disc-shaped member 60 is capable of providing an additional pump action to the pump action which is caused by the rotation of the cutter member 20. This has a number of advantages. Among other things, it is ensured that initial filling of the interior space 15 of the shaving head 10 takes place, so that the pump action which is caused by the rotation of the cutter member 20 is surely effective, and the cleaning process is performed in a proper manner. In case only the pump action caused by the rotation of the cutting member 20 is available, it may be a problem to have a complete filling of the interior space 15 of the shaving head 10 and to obtain good cleaning results. Furthermore, use of the cleaning unit 5 involves pollution of the filter 33, wherein the filter 33 may eventually get clogged. The suction force which is generated by a rotation of the cutting member 20 may be too low to cause a flow of fluid 41 in such a situation, whereas there is no such problem if an additional pump action is realized by a relative movement of the separating tube 30 and the disc-shaped member 60.

On the basis of the above-described additional pump action of the combination of the separating tube 30 and the disc-shaped member 60, it is even possible to clean shaving heads 10 having at least one relatively large opening, for example an opening in the base element 11, still without the need of applying a separate assembly for pumping the cleaning fluid 41. It is clear that in such shaving heads 10, the extent to which a rotation of the cutter member 20 leads to a building up of pressure inside the shaving head 10 is limited. However, when the combination of the separating tube 30 and the disc-shaped member 60 is applied for generating a pumping effect as well, it is still possible to have a good cleaning process, in particular the flow of fluid 41 needed in the process.

Figure 13:
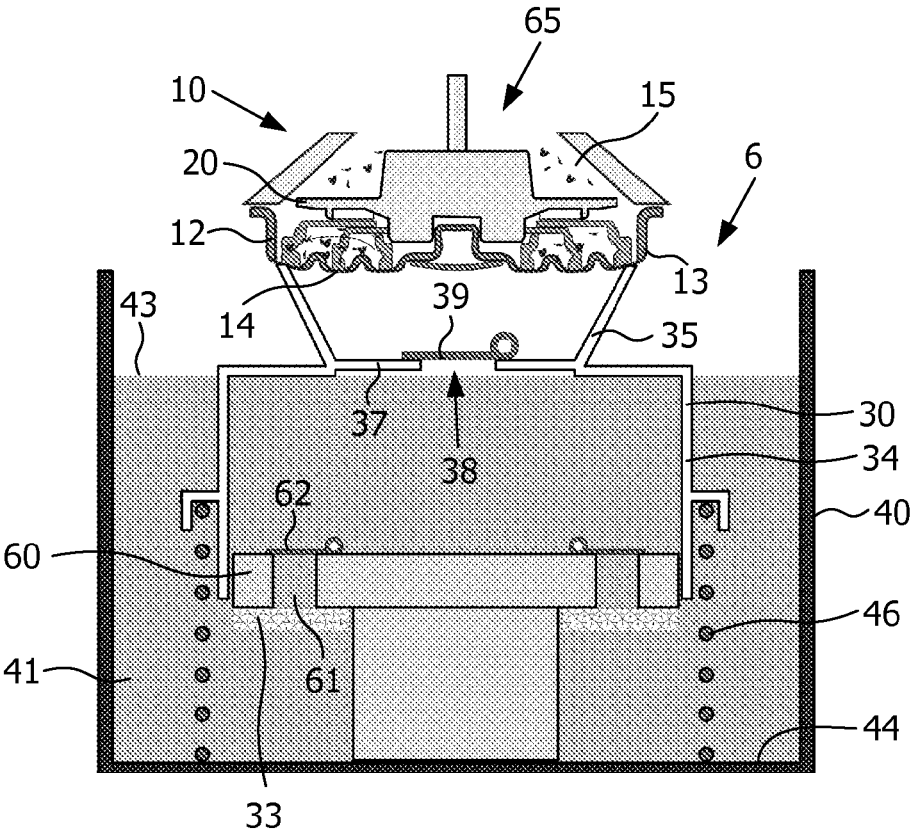
FIG. 13 diagrammatically shows a side view of a cross-section of a shaving head of a shaver and a cleaning unit according to a sixth preferred embodiment of the present invention, in a situation of first use of the cleaning unit and initial positioning of the shaving head with respect to the cleaning unit.
Figure 14:
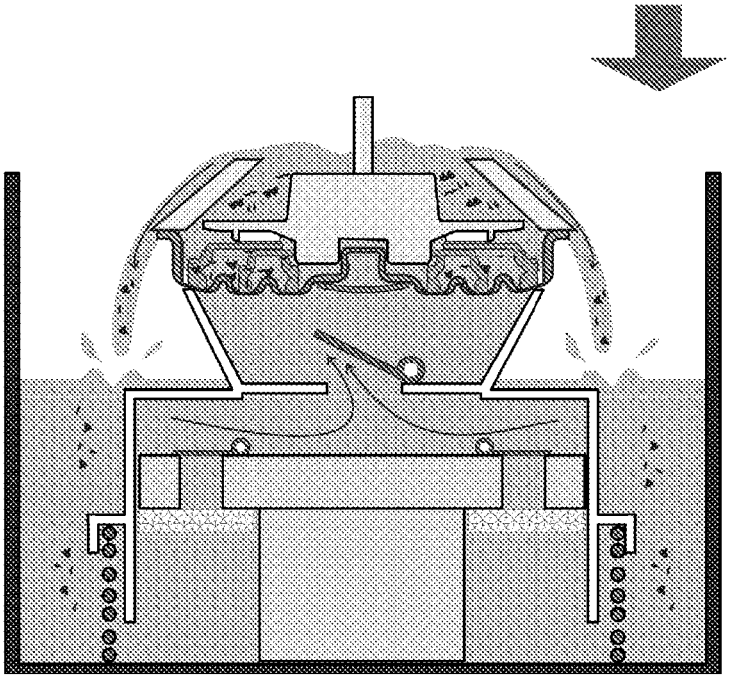
FIG. 14 diagrammatically shows the shaving head and the cleaning unit as shown in FIG. 13, during a cleaning process.
Figure 15:
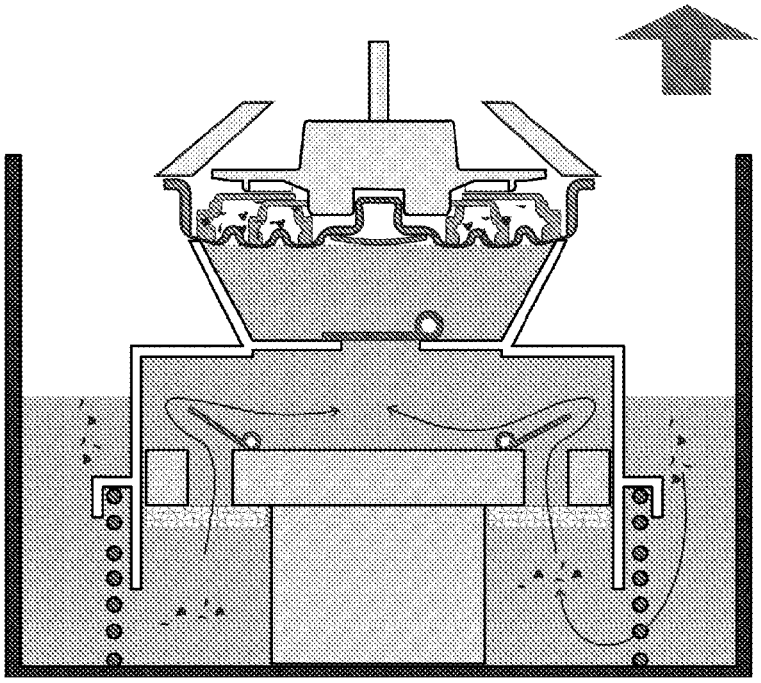
FIG. 15 diagrammatically shows the shaving head and the cleaning unit as shown in FIGS. 13 and 14, in a situation in which the shaving is retracted with respect to the cleaning unit.

In FIGS. 13-15, a cleaning unit 6 according to a sixth preferred embodiment of the present invention is shown, which is particularly suitable to be used for the purpose of cleaning shaving heads 10 which are opened at the side of the base element 11. An example of such a shaving head 10 is shown in the said Figures.

The cleaning unit 6 according to the sixth preferred embodiment of the present invention resembles the cleaning unit 5 according to the fifth preferred embodiment of the present invention to a large extent. A difference resides in the fact that the upper tube section 35 has a tapered appearance, wherein an inner diameter at the outlet end 31 resembles the diameter of the cap 12 of a shaving head 10 to be cleaned, so that the separating tube 30 is capable of covering the contacting surface 14 completely. This is possible, because there is no need for using a portion of the contacting surface 14 for discharging fluid 41 from the shaving head 10. Instead, the opening 65 in the base element 11 of the shaving head 10 may be used.

In principle, the cleaning unit 6 according to the sixth preferred embodiment of the present invention functions in the same manner as the cleaning unit 5 according to the fifth preferred embodiment of the present invention. FIG. 14 illustrates the fact that when the shaving head 10 and the separating tube 30 are pressed in a downward direction, the cleaning fluid 41 is forced to flow through the shaving head 10, wherein the fluid 41 enters the shaving head 10 through the holes in the contacting surface 14 and exits the shaving head 10 through the opening 65 in the base element 11. In the process, a rotation of the cutter member 20 contributes to the effectiveness of the cleaning process which is performed by means of the fluid 41. A refraction of the shaving head 10 is illustrated by FIG. 15. Like in FIGS. 10-12, a direction of movement of the shaving head 10 and the separating tube 30, and a direction of the flow of cleaning fluid 41 are indicated by means of arrows in FIGS. 14 and 15.

Figure 16:
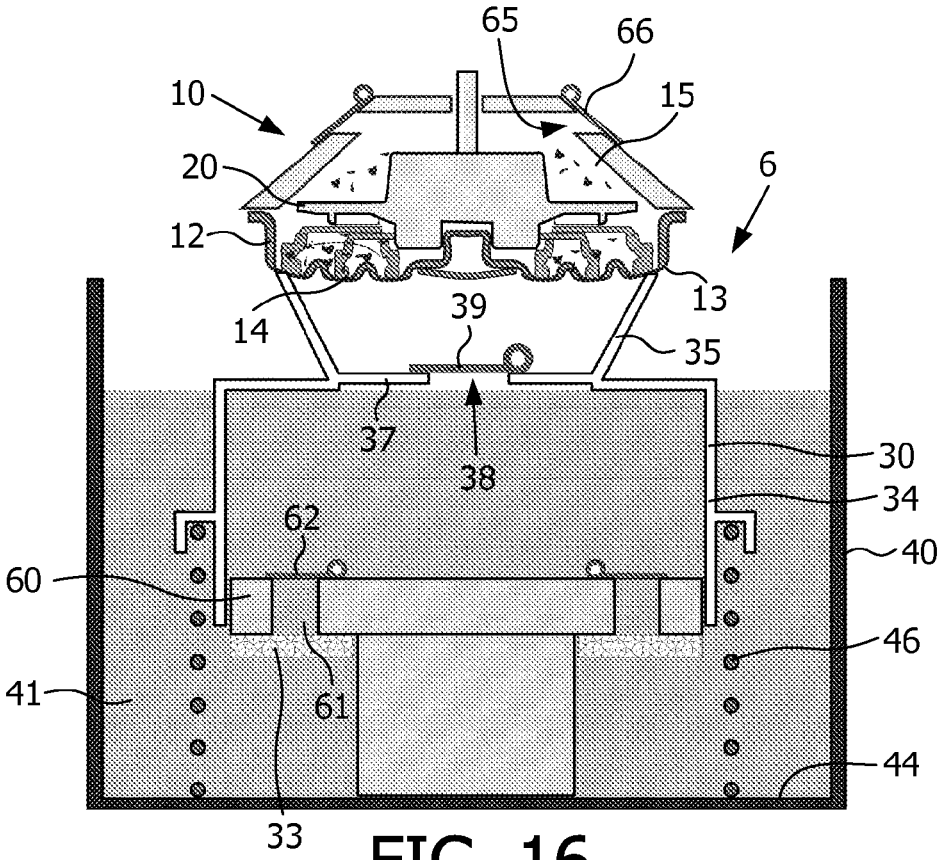
FIGS. 16-18 illustrate an application of the cleaning unit as shown in FIGS. 13-15 with an alternative type of shaving head.
Figure 17:
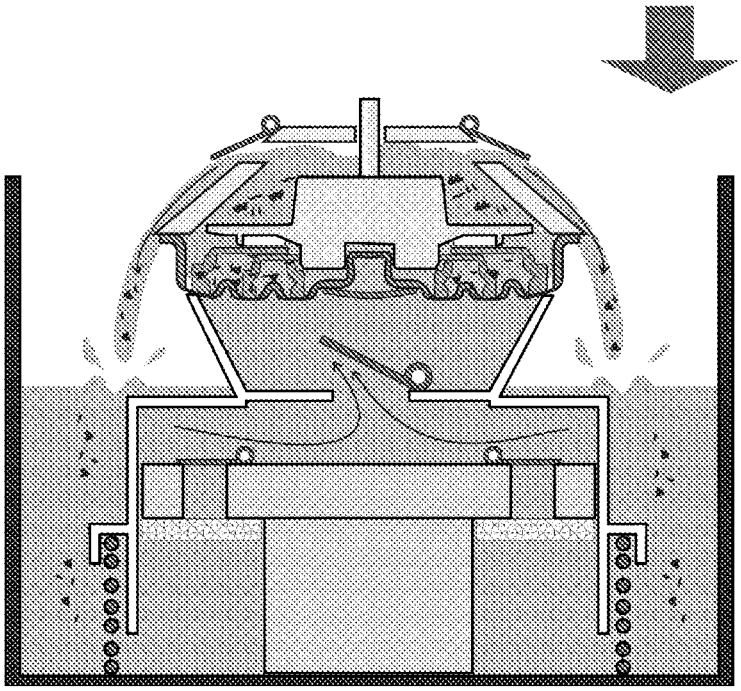
Figure 18:
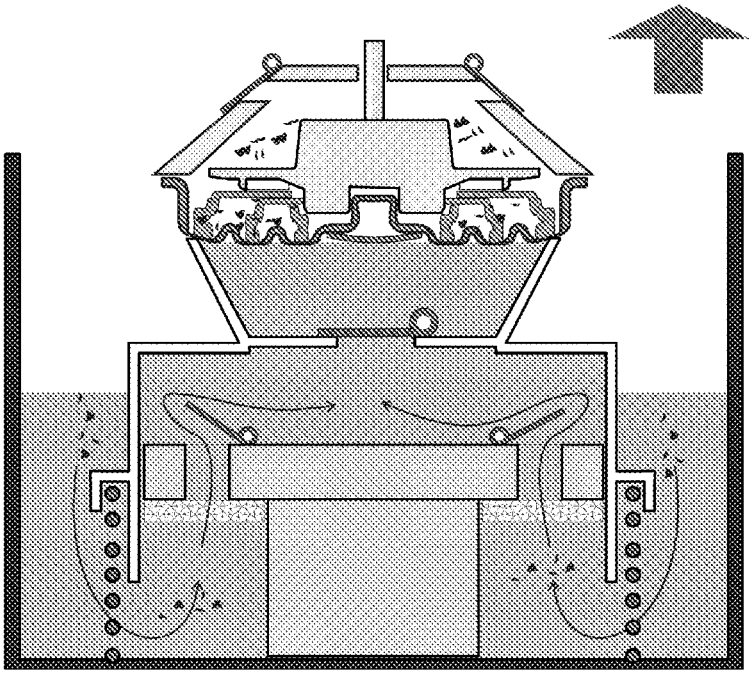

The cleaning unit 6 according to the sixth preferred embodiment of the present invention is shown in FIGS. 16-18 as well. In these Figures, however, another type of shaving head 10 is shown, namely a shaving head 10 which has an opening 65 arranged in the base element 11, and valve means 66 for closing the opening 65. Normally, the valve means 66 are in a closed position, but during a cleaning process, the valve means 66 are in an opened position under the influence of the flow of cleaning fluid 41 when the shaving head 10 and the separating tube 30 are pressed in the downward direction, as shown in FIG. 17.

It is noted that all shown embodiments of the cleaning unit 1, 2, 3, 4, 5, 6 according to the present invention are easy to use. A user only needs to take care that the container 40 is filled with a sufficient quantity of cleaning fluid 41, to put the shaving head 10 in a proper position with respect to the separating tube 30, and to activate the cutter member 20 of the shaving head 10 such as to rotate. Additionally, it may be necessary to retract the shaving head 10 along a certain length, once the shaving head 10 is filled with cleaning fluid 41 and a cleaning process is started, as has been described in relation to the second preferred embodiment, or to exert pressure on the shaving head 10 in order to move the shaving head 10 in a direction towards the bottom 44 of the container 40, and to release the shaving head 10 again later on, as has been described in relation to the fifth and sixth preferred embodiment.

When the shaving head 10 to be cleaned has a relatively small hair chamber 17, a centrifugal pump action which is realized when the cutter member 20 of the shaving head 10 is moved is sufficient for causing a flow of fluid 41 inside the shaving head 10 which is necessary for achieving good cleaning results. Hence, when the cleaning unit 1, 2, 3, 4, 5, 6 is intended to be applied for the purpose of cleaning such a shaving head 10, there is no need for any modification of the shaving head 10. In particular, there is no need for adding fluid impellers or the like. Furthermore, there is no need for arranging additional holes in the outer surface 13 of the shaving head 10, as the holes in the cap 12 of the shaving head 10 which serve for letting through hairs during a shaving action are also suitable for letting through cut-off hairs and dirt particles 42, and the same is true for openings 65 which may be present at the side of the base element 11 of the shaving head 10.

Advantageously, the cleaning unit 1, 2, 3, 4, 5, 6 according to the present invention comprises a unit for receiving and holding the shaver having the shaving head 10 to be cleaned during a cleaning process. Furthermore, the cleaning unit 1, 2, 3, 4, 5, 6 may comprise other additional means, such as means for charging a battery of the shaver in case the shaver is of a cordless type.

Besides the six shown embodiments of the cleaning unit, more embodiments are feasible within the scope of the present invention.

Figure 19:
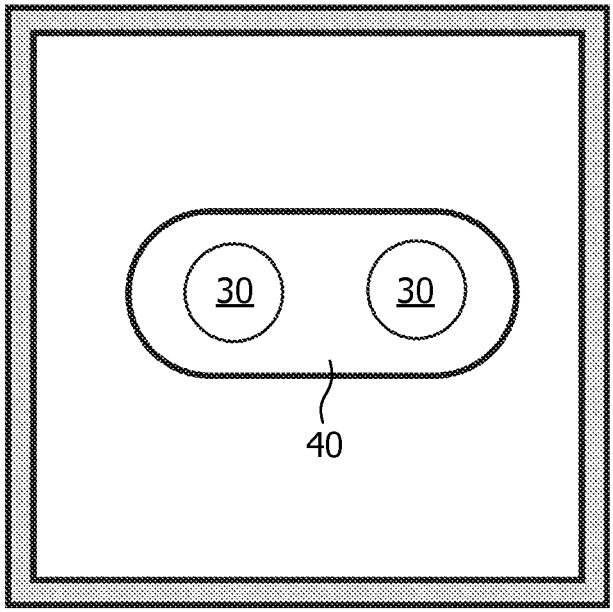
FIG. 19 diagrammatically shows a top view of a cleaning device having two cleaning units according to the present invention.
Figure 20:
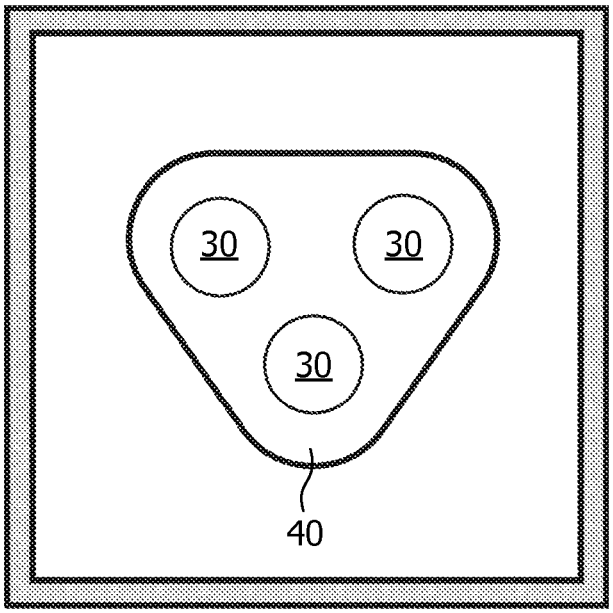
FIG. 20 diagrammatically shows a top view of a cleaning device having three cleaning units according to the present invention.

The cleaning unit 1, 2, 3, 4, 5, 6 according to the present invention may be part of a cleaning device which is suitable to be applied for the purpose of cleaning shaving heads 10 of a shaver having more than one shaving head 10. Preferably, in such a case, the cleaning device comprises only one container 40, and a number of separating tubes 30 and an associated arrangement, wherein positions of the separating tubes 30 are adapted to positions of the shaving heads 10 of a shaver to be cleaned by means of the cleaning device. Examples of such cleaning devices are shown in FIGS. 19 and 20. The cleaning device 7 as shown in FIG. 19 comprises two separating tubes 30 and one container 40, and is suitable to be used for the purpose of cleaning two shaving heads 10 of a shaver, and a mutual position of central axes of the shaving heads 10 is substantially equal to a mutual position of central axes of the separating tubes 30. The cleaning device 8 as shown in FIG. 20 comprises three separating tubes 30 and one container 40, and is suitable to be used for the purpose of cleaning three shaving heads 10 of a shaver, and a mutual position of central axes of the shaving heads 10 is substantially equal to a mutual position of central axes of the separating tubes 30, which is such that a triangular configuration is obtained.

Figure 21:
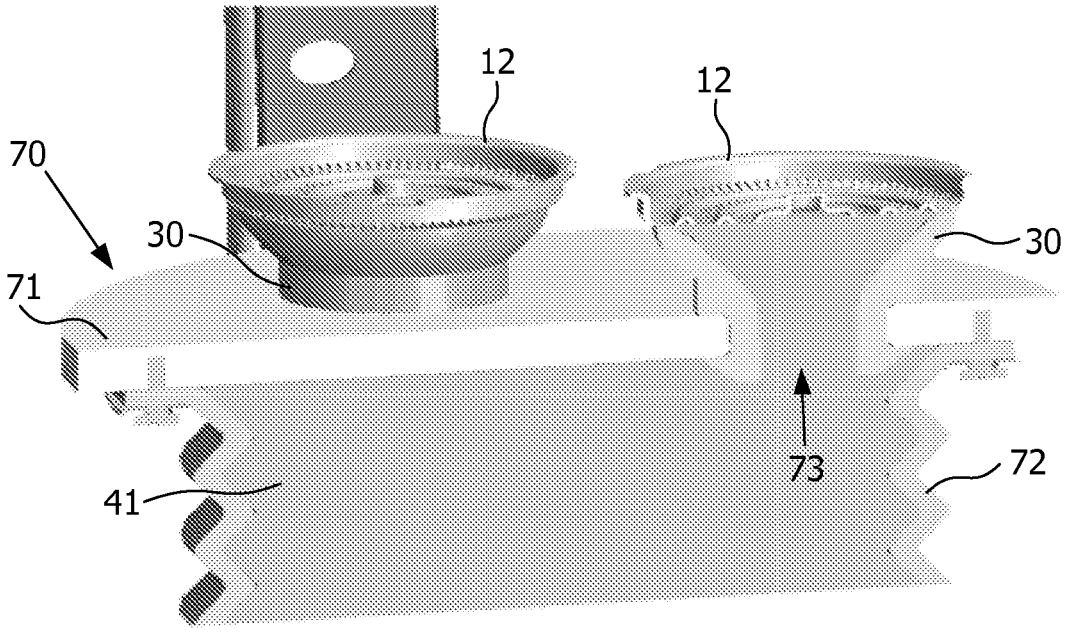
FIG. 21 diagrammatically shows a sectional view of a portion of a cleaning device and caps of shaving heads of a shaver to be cleaned by applying the device.

Preferably, in case the cleaning device 7, 8 comprises a cleaning unit like the cleaning unit 5 according to the fifth preferred embodiment of the present invention, or the cleaning unit 6 according to the sixth preferred embodiment of the present invention, i.e. a cleaning unit in which an additional pump action may be realized by moving the shaving head 10 and the separating tube 30 down in the container 40, the cleaning unit 7, 8 further comprises a unit (not shown) for receiving and holding the shaver, wherein means are provided to realize the desired displacement of the shaver during operation of the device 7, 8. Furthermore, in such a case, an arrangement in which the separating tubes 30 of the various cleaning units are all movable to an equal extent may very well be realized by having the separating tubes 30 mounted on a common element which is adapted to allow for the desired movement of the separating tubes 30. An example of such a common element is shown in FIG. 21. In particular, in the Figure, it is shown how the various separating tubes 30 may be mounted on a common carrier plate 71, wherein the carrier plate 71 is arranged at a top end of a single tube-shaped bellows 72, and wherein the carrier plate 71 is provided with holes 73 at the positions of the separating tubes 30. Additionally, FIG. 21 illustrates how caps 12 of shaving heads 10 of a shaver are positioned on the separating tubes 30 of the cleaning units when the shaver is received in the cleaning device of which the cleaning units are part. At the start of a cleaning process, when the shaver is pressed deeper in the cleaning device, pressure is exerted on the bellows 72 through the separating tubes 30 and the carrier plate 71, as a result of which the bellows 72 is compressed. At a certain point, this causes cleaning fluid 41 to be pressed towards the shaving heads 10, through the separating tubes 30.

Once the cleaning process has started and the cutter members 20 of the shaving heads 10 are rotated such as to have a pump action, the cleaning fluid 41 is continuously supplied to the shaving heads 10 through the bellows 72 and the separating tubes 30. It is advantageous to have the separating tubes 30 mounted on a common element 70 which is adapted to allow for the movement of the separating tubes 30, as in that case, the construction may be simpler than in the case that there are as many elements as separating tubes 30, and each of the separating tubes 30 is mounted on another of these elements. Most advantageously, the element 70 on which the separating tubes 30 are mounted is furthermore capable of allowing for a supply of cleaning fluid 41 to the separating tubes 30, as is the case with the shown example of an assembly 70 of a carrier plate 71 and a tube-shaped bellows 72.

The cleaning unit 1, 2, 3, 4, 5, 6 according to the present invention may be used for the purpose of cleaning any type of shaving head 10, provided that holes/openings are arranged in at least a portion of the outer surface 13 of the shaving head 10. In case the shaving head 10 comprises a cap 12 having such holes/openings, the contacting surface 14 of this cap 12 does not necessarily need to comprise a number of annular corrugations 14*a*, 14*b*, 14*c*, but may have any shape.

It will be clear to a person skilled in the art that the scope of the present invention is not limited to the examples discussed in the foregoing, but that several amendments and modifications thereof are possible without departing from the scope of the present invention as defined in the attached claims. While the present invention has been illustrated and described in detail in the Figures and the description, such illustrations and descriptions are to be considered illustrative or exemplary only, and not restrictive. The present invention is not limited to the disclosed embodiments.

Variations to the disclosed embodiments can be understood and effected by a person skilled in the art in practicing the claimed invention, from a study of the Figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In the foregoing, a cleaning unit 1, 2, 3, 4, 5, 6 has been described, which is suitable to be applied for the purpose of cleaning an interior space 15 of a shaving head 10 of a shaver, which shaving head 10 comprises a movably arranged cutter member 20 for cutting off hairs, and a contacting surface 14 for contacting a portion of skin to be shaved, which is provided with a plurality of holes for catching and letting through hairs to be shaved off by means of the cutter member 20. In particular, the cleaning unit 1, 2, 3, 4, 5, 6 comprises a separating tube 30 for constituting a physical barrier between two portions of an outer surface 13 of the shaving head 10 and for conveying cleaning fluid 41. During a cleaning process, the fluid 41 is pumped from a container 40 of the cleaning unit 1, 2, 3, 4, 5, 6 to the interior space 15 of the shaving head 10, through the separating tube 30 of the cleaning unit 1, 2, 3, 4, 5, 6 and the holes in the contacting surface 14 of the shaving head 10, under the influence of a centrifugal pump action which is obtained when the cutter member 20 of the shaving head 10 is in motion and/or a pump action which is obtained when the shaving head 10 is pressed against the separating tube 30 and the separating tube 30 is consequently moved in a direction toward a bottom 44 of the container 40 in an embodiment in which the separating tube 30 is arranged such as to be a movable part of a piston-cylinder construction. In any case, under the influence of the centrifugal pump action caused by a the cutter member 20, the flow of fluid 41 inside the shaving head 10 is agitated, so that the cleaning action of the fluid 41 is most effective.

The invention claimed is:

1. A system for cleaning a shaver head, said system comprising: a cleaning unit and a shaver having a shaving head;

said shaving head comprising:

at least one rotary cutter for cutting off hairs, said rotary cutter being arranged inside an interior space of the shaving head for rotafon about an axis;

a cover member enclosing the at least one rotary cutter in the shaving head and including an outer portion and an inner portion with respect to said axis, each extending transversely of said axis and including at least one opening, said outer portion being further from the axis than the inner portion;

said cleaning unit comprising:

a container, suitable for containing a cleaning liquid therein, said container including:

a circumferential member:

contacting an exterior surface of the cover member and surrounding the at least one opening in the inner portion, thereby forming a physical barrier between, and separating, the openings in the inner and outer portions of said shaver head; and retaining said exterior surface of the cover member above said cleaning liquid;

wherein in response to a centrifugal force produced by operation of the at least one rotary cutter, the cleaning liquid is drawn into the interior space via the at least one opening in the inner portion of the cover member and ejected from the interior space via the at least one opening in the outer portion of the cover member.

2. An apparatus comprising:

a cleaning unit; and a shaver having a shaving head, said shaving head comprising:

at least one rotary Cutter for cutting off hairs, said at least one rotary cutter being arranged inside an interior space of the shaving head for rotation about a common axis;

a cover member enclosing the rotary cutters in the shaving head and including an outer annular corrugation and an inner annular corrugation disposed around said axis and arranged for contacting, on respective outside surfaces, portions of skin to be shaved, said outer and inner annular corrugations each including a plurality of openings for letting through hairs to be shaved off by the at least one cutter; and said cleaning unit comprising:

a container, said container comprising:

a first circumferential member:

contacting an outside surface of the shaver head cover member at a location disposed between the outer and inner annular corrugations and forming a physical barrier between, and separating, said outer and inner annular corrugations; and retaining an exterior surface of said cover member from engaging said liquid, wherein a liquid, contained within said container, is drawn, in reaction to a centrifugal force produced by operation of the at least one cutter into the interior space via the openings in the inner annular corrugation and ejected from the interior space via the openings in the outer annular corrugation.

* * * * *